US008292653B2

(12) United States Patent
Tang

(10) Patent No.: US 8,292,653 B2
(45) Date of Patent: Oct. 23, 2012

(54) PLUG, SOCKET, AND CONNECTOR USING THE SAME

(75) Inventor: Xing-Hua Tang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 120 days.

(21) Appl. No.: 12/907,992

(22) Filed: Oct. 20, 2010

(65) Prior Publication Data

US 2012/0028491 A1 Feb. 2, 2012

(30) Foreign Application Priority Data

Jul. 30, 2010 (CN) ..... 2010 1 0241306

(51) Int. Cl.
*H01R 13/62* (2006.01)

(52) U.S. Cl. ..... 439/372

(58) Field of Classification Search ..... 439/372, 439/157, 376, 374, 541.5, 260, 153, 140–141, 439/152

See application file for complete search history.

(56) References Cited

U.S. PATENT DOCUMENTS

| | | | | |
|---|---|---|---|---|
| 5,971,779 | A * | 10/1999 | Okabe | 439/157 |
| 6,056,582 | A * | 5/2000 | Okabe | 439/372 |
| 6,364,681 | B1 * | 4/2002 | Watanabe | 439/335 |
| 6,592,384 | B2 * | 7/2003 | Sawayanagi | 439/157 |
| 7,955,110 | B1 * | 6/2011 | Kataoka et al. | 439/284 |
| 7,963,781 | B2 * | 6/2011 | Takahashi et al. | 439/157 |
| 8,016,602 | B2 * | 9/2011 | Wadoux | 439/157 |
| 2003/0109166 | A1 * | 6/2003 | Ookura | 439/372 |
| 2010/0120284 | A1 * | 5/2010 | Oka et al. | 439/372 |
| 2010/0227494 | A1 * | 9/2010 | Tyler et al. | 439/372 |

* cited by examiner

*Primary Examiner* — Jean F Duverne
(74) *Attorney, Agent, or Firm* — Altis Law Group, Inc.

(57) ABSTRACT

A connector includes a plug, a socket corresponding to the plug, and a protection assembly rotatably connected to one of the plug and the socket. The protection assembly is configured for encompassing the other one of the plug and the socket to firmly fixed the plug and the socket together when the plug is inserted into the socket.

14 Claims, 4 Drawing Sheets

PLUG, SOCKET, AND CONNECTOR USING THE SAME

BACKGROUND

1. Technical Field

The present disclosure relates to connectors, and more particularly to a connector having a plug and a socket corresponding to the plug.

2. Description of Related Art

An electrical plug is inserted into a socket to provide electrical power to an electronic device. However, the plug may be easily dislodge from the socket by inadvertent tugging or pulling of the cord attached to the plug, or the prongs of the plug may even be exposed and thereby posing an electrical hazard.

Therefore, there is room for improvement in the art.

BRIEF DESCRIPTION OF THE DRAWINGS

The components of the drawings are not necessarily drawn to scale, the emphasis instead being placed upon clearly illustrating the principles of the embodiment of a connector having a plug and a corresponding socket. Moreover, in the drawings, like reference numerals designate corresponding parts throughout the views.

DETAILED DESCRIPTION

Embodiments of the present disclosure will now be described in detail with reference to the drawings.

Figure 1:
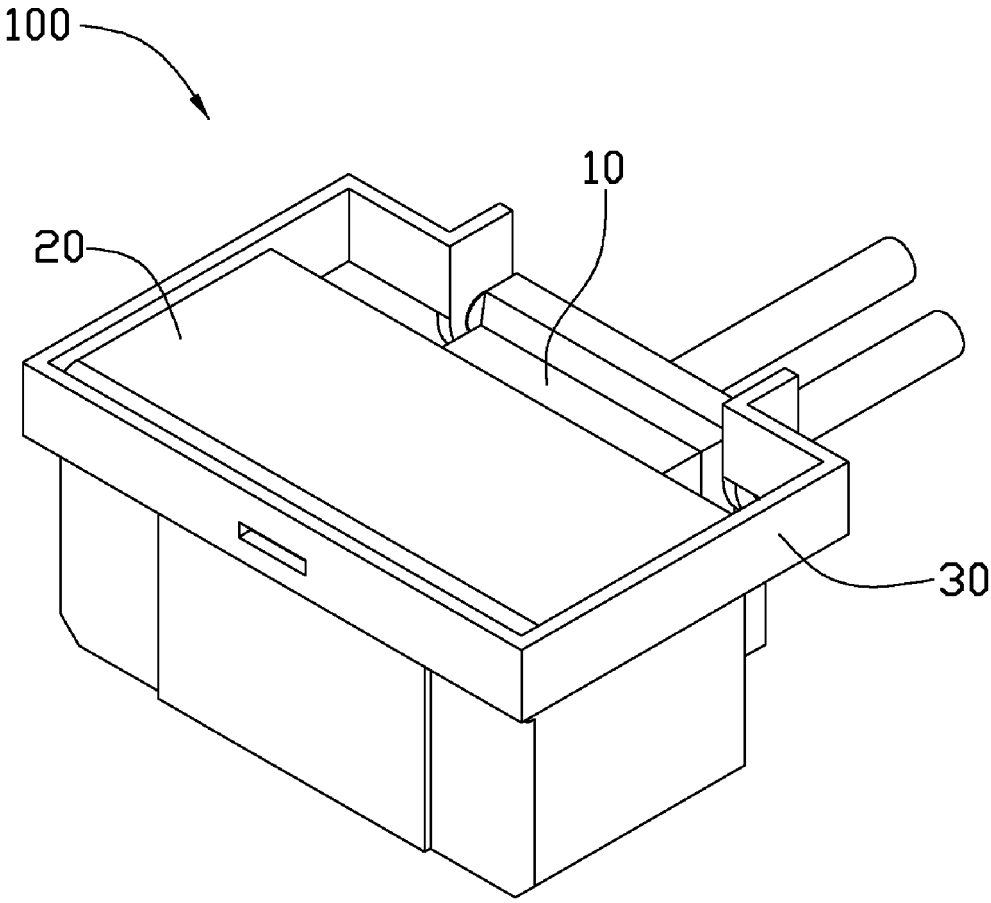
FIG. 1 is an isometric, schematic view of a connector according to an exemplary embodiment.

Referring to FIG. 1, a connector 100 according to an exemplary embodiment is illustrated. The connector 100 includes a plug 10, a socket 20 corresponding to the plug 10, and a protection assembly 30 for fastening the plug 10 and the socket 20 together when the plug 10 is inserted into the socket 20.

Figure 2:
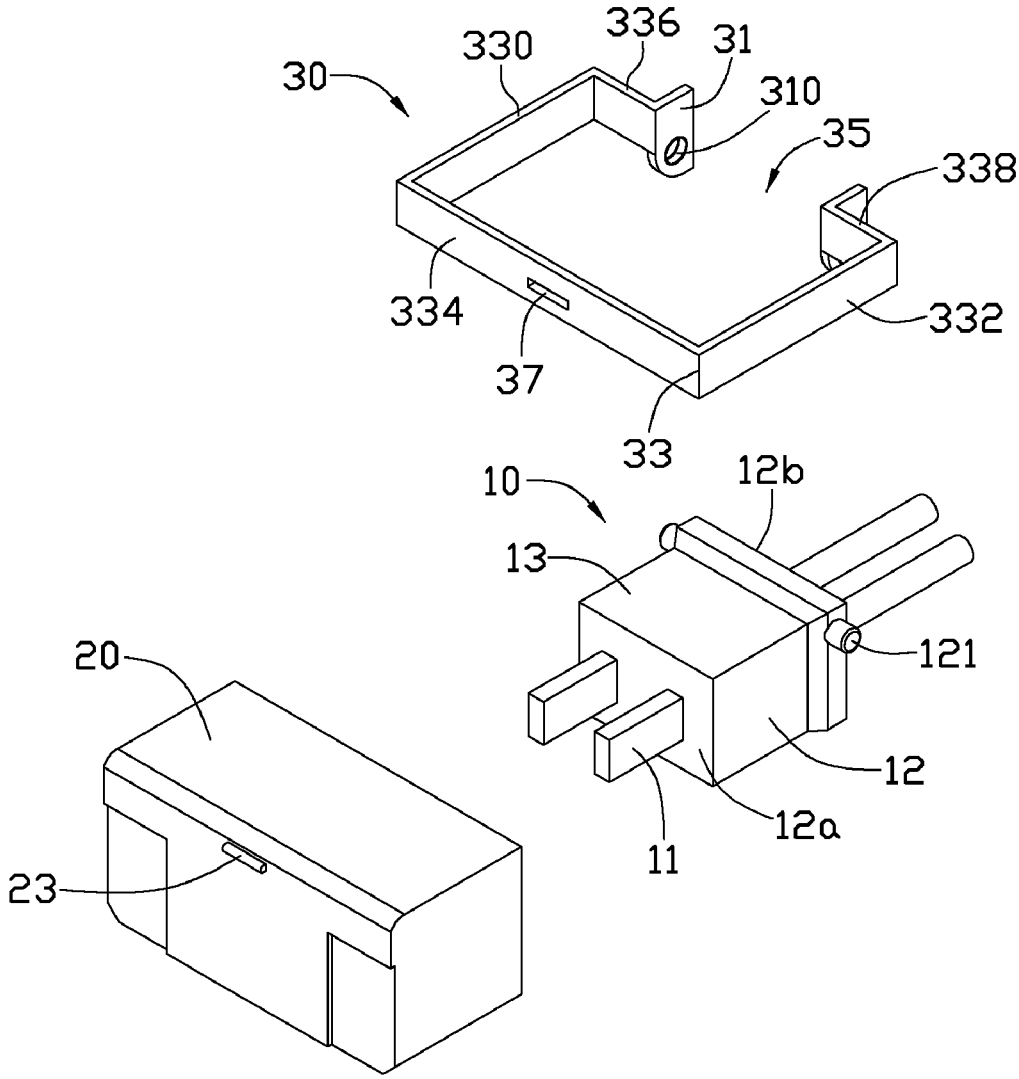
FIG. 2 is an exploded view of the connector of FIG. 1.

Referring to FIG. 2, the plug 10 includes two parallel prongs 11 and a body 12. The body 12 defines a pronged surface 12*a*, a cord surface 12*b* opposite to the pronged surface 12*a*, and a side surface 13 connecting the pronged surface 12*a* to the cord surface 12*b*. Two cylindrical shafts 121 are respectively disposed on two opposite sides of the side surface 13. In this embodiment, the two shafts 121 coaxially and respectively extend from the side surface 13 and are parallel to the pronged surface 12*a* and the cord surface 12*b*. The prongs 11 extend from the pronged surface 12*a*.

Figure 3:
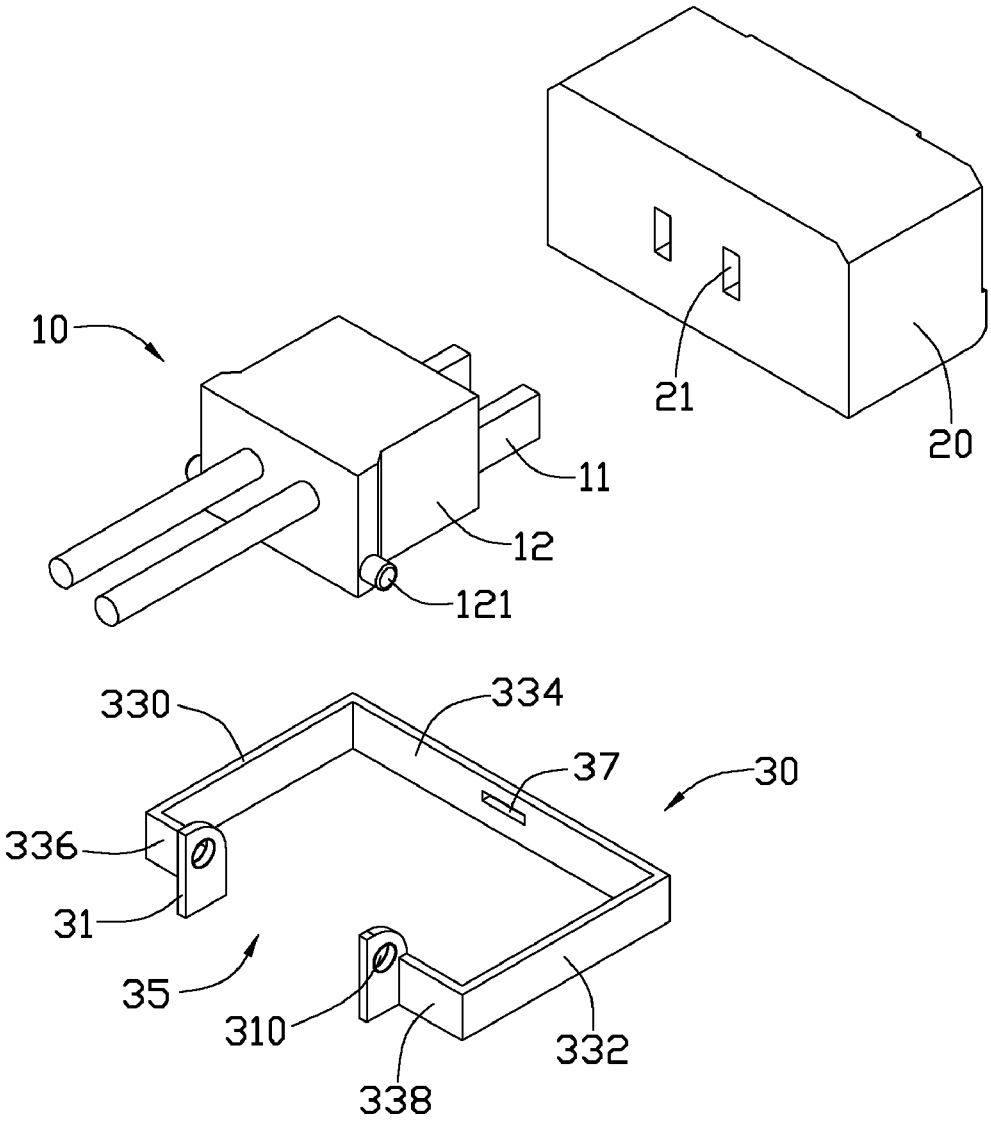
FIG. 3 is similar to FIG. 1, but showing the connector from another angle.

Also referring to FIG. 3, the socket 20 defines two insertion holes 21 corresponding to the two prongs 11. The two insertion holes 21 are used for respectively receiving the two prongs 11. When the two prongs 11 are inserted into the two insertion holes 21, the two prongs 11 are electrically connected to electrical contacts (not shown) embedded in the socket 20. In this embodiment, the number of the insertion holes 21 is equal to that of the prongs 11. The socket 20 includes an arc-shaped protrusion 23. The protrusion 23 and the insertion holes 21 are on opposite sides of the socket 20.

The protection assembly 30 includes a frame structure 33 and two connecting parts 31. The shape of the frame structure 33 corresponds to that of the socket 20. The frame structure 33 includes a first frame 330, a second frame 332 parallel to the first frame 330, and a third frame 334 perpendicularly connected to one end each of the first and second frames 330, 332. The other end of the first frame 330 is bent perpendicularly to form a fourth frame 336. The other end of the second frame 332 is bent perpendicularly to form a fifth frame 338 and aligned with the fourth frame 336.

One of the two connecting parts 31 is disposed on the end of the fourth frame 336 away from the first frame 330, the other one of the two connecting parts 31 is disposed on the end of the fifth frame 338 away from the second frame 332. The two connecting parts 31 are aligned with each other and define a gap 35. Each connecting part 31 defines an axle hole 310 for rotatably receiving one shaft 121 of the plug 10. When the two shafts 121 are respectively received in the two axle holes 310, the plug 12 is positioned in the gap 35, and the frame structure 33 is rotatably connected to the plug 12.

The third frame 334 defines an arc-shaped receiving hole 37. The receiving hole 37 corresponds with the protrusion 23 and is used for receiving the protrusion 23. In this embodiment, the receiving hole 37 is a through hole in the third frame 334. In other embodiments, the receiving hole 37 can be a blind hole in the third frame 334.

When the connector 100 is used, the two prongs 11 of the plug 10 are inserted into the two insertion holes 21 of the socket 20. Thus, the plug 10 is electrically connected to the socket 20. The protection assembly 30 is capable of rotating about the shafts 121 from a first position in which the protection assembly 30 encompasses the socket 20 and a second position in which the protection assembly 30 departs from the socket 20. When the protection assembly 30 encompasses the socket 20, the connection between the plug 10 and the socket 20 is protected. The protrusion 23 is capable of being received in the receiving hole 37 when the protection assembly 30 encompasses the socket 20 to reinforce the engagement between the protection assembly 30 and the socket 20. Thus, the plug 10 and the socket 20 are firmly fixed together by the protection assembly 30.

In other embodiments, the protrusion can be disposed on the third frame of the frame structure. Then, the receiving hole for receiving the protrusion can be defined on the socket accordingly.

Figure 4:
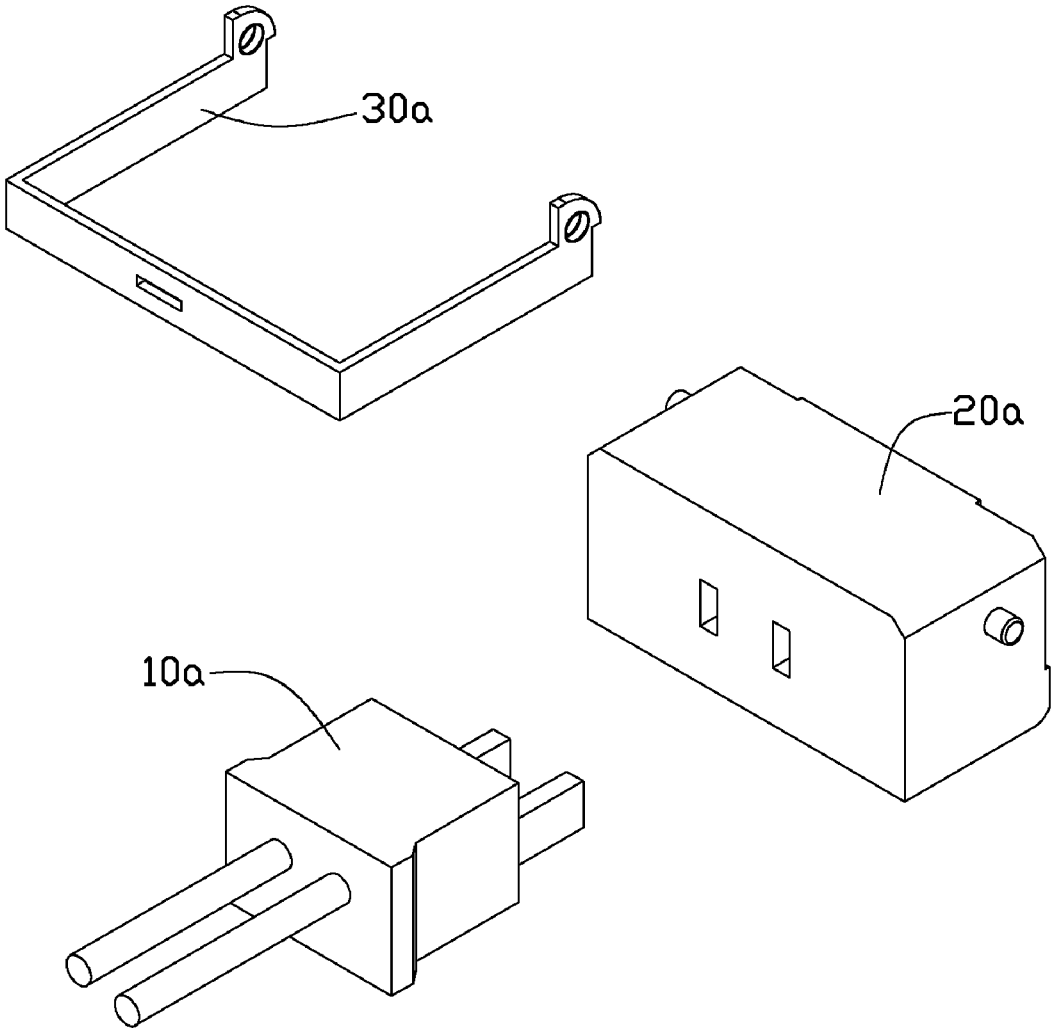
FIG. 4 is an isometric, schematic view of a connector according to another exemplary embodiment.

Referring to FIG. 4, in other embodiments, the protection assembly 30*a* is rotatably disposed on the socket 20*a*. The shape of the protection assembly 30*a* corresponds to that of the plug 10*a*. When the plug 10*a* insert into the socket 20*a*, the protection assembly 30*a* encompasses the plug 10*a* to firmly fixed the plug 10*a* and the socket 20*a* together.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation to encompass all such modifications and similar arrangements.

What is claimed is:

1. A connector, comprising:

a plug;

a socket corresponding to the plug and for allowing the plug to be inserted therein in a first direction; and a protection assembly rotatably connected to one of the plug and the socket, the protection assembly configured for resisting against an end of the other one of the plug and the socket opposite to the one of the plug and the socket to prevent the other one of the plug and the socket from disengaging with the one of the plug and the socket in a second direction opposite to the first direction when the plug is inserted into the socket;

wherein the protection assembly comprises a frame structure and two connecting parts disposed on the frame structure, the frame structure is for encompassing the other one of the plug and the socket when the plug is inserted into the socket, the two connecting parts are for rotatably connecting with one of the plug and the socket; wherein two cylindrical shafts are respectively disposed on two opposite sides of the one of the plug and the socket, the two cylindrical shafts are respectively and rotatably connected to the two connecting parts of the protection assembly.

2. The connector of claim 1, wherein the other one of the plug and the socket comprises an arc-shaped protrusion, the protection assembly defines an arc-shaped receiving hole, and the receiving hole is configured for receiving the protrusion to latch the protection assembly.

3. The connector of claim 1, wherein the other one of the plug and the socket comprises an arc-shaped receiving hole, the protection assembly defines an arc-shaped protrusion, and the receiving hole is configured for receiving the protrusion to latch the protection assembly.

4. The connector of claim 1, wherein the two shafts coaxially and respectively extend from two opposite sides of the one of the plug and the socket.

5. The connector of claim 1, wherein two axle holes are respectively defined on the two connecting parts, and the two axle holes are used for receiving the two shafts respectively.

6. The connector of claim 1, wherein the frame structure comprises a first frame, a second frame parallel to the first frame, and a third frame perpendicular connected to one end each of the first frame and the second frame, the first frame is bent perpendicularly to form a fourth frame, the second frame is bent perpendicularly to form a fifth frame and aligned with the fourth frame, the two connecting parts are respectively disposed on the fourth frame and the fifth frame to aligned with each other and to define a gap.

7. A plug capable to be inserted into a socket in a first direction, comprising:

a body defining a pronged surface resisting against the socket when the plug is inserted into the socket, a cord surface opposite to the pronged surface, and a side surface connecting the pronged surface to the cord surface, two opposites shafts provided on the side surface; and a protection assembly, two ends of the protection assembly rotatably connected to the two shafts of the body, the protection assembly configured for resisting against an end of the socket opposite to the plug to prevent the socket from disengaging with the plug in a second direction opposite to the first direction when the plug is inserted into the socket;

wherein the frame structure comprises a first frame, a second frame parallel to the first frame, and a third frame perpendicular connected to one end each of the first frame and the second frame, the first frame is bent perpendicularly to form a fourth frame, the second frame is bent perpendicularly to form a fifth frame and aligned with the fourth frame, the two connecting parts are respectively disposed on the fourth frame and the fifth frame to aligned with each other and to define a gap.

8. The plug of claim 7, wherein one of the body and the protection assembly comprises an arc-shaped protrusion, the other one of the body and the protection assembly defines an arc-shaped receiving hole, the receiving hole is configured for receiving the protrusion to latch the protection assembly.

9. The plug of claim 7, wherein the protection assembly comprises a frame structure and two connecting parts disposed on the frame structure, the frame structure is for encompassing the socket when the plug is inserted into the socket, the two connecting parts are for rotatable connecting with the two shafts.

10. The plug of claim 7, wherein the two shafts coaxially and respectively extend from the two opposite sides of the side surface.

11. A socket capable of having a plug being inserted therein in a first direction, comprises:

a body, the body defining a front surface, a back surface opposite to the front surface, and a side surface connecting the front surface to the back surface, two opposites shafts provided on the side surface, a plurality of insertion holes defined on the front surface; and a protection assembly, two ends of the protection assembly rotatably connected to the two shafts of the body, the protection assembly configured for resisting against an end of the plug opposite to the socket to prevent the plug from disengaging with the socket in a second direction opposite to the first direction when prongs of the plug are inserted into the insertion holes of the socket;

wherein the frame structure comprises a first frame, a second frame parallel to the first frame, and a third frame perpendicular connected to one end each of the first frame and the second frame, the first frame is bent perpendicularly to form a fourth frame, the second frame is bent perpendicularly to form a fifth frame and aligned with the fourth frame, the two connecting parts are respectively disposed on the fourth frame and the fifth frame to aligned with each other and to define a gap.

12. The socket of claim 11, wherein one of the body and the protection assembly comprises an arc-shaped protrusion, the other one of the body and the protection assembly defines an arc-shaped receiving hole, and the receiving hole is configured for receiving the protrusion to latch the protection assembly.

13. The socket of claim 11, wherein the protection assembly comprises a frame structure and two connecting parts disposed on the frame structure, the frame structure is for encompassing the plug when the plug is inserted within the socket, and the two connecting parts are for rotatable connecting with the two shafts.

14. The socket of claim 11, wherein the two shafts coaxially and respectively extend from two opposite sides of the side surface.

* * * * *